US007508875B1

(12) United States Patent
Somin

(10) Patent No.: US 7,508,875 B1
(45) Date of Patent: Mar. 24, 2009

(54) CORRELATION MATRIX ESTIMATION VIA ADAPTIVE ARRAY PERTURBATIONAL PROCESSING TO ENABLE JAMMER LOCATION

(75) Inventor: Martin E. Somin, Huntington, NY (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 603 days.

(21) Appl. No.: 11/227,693

(22) Filed: Sep. 15, 2005

(51) Int. Cl.
*H04K 1/10* (2006.01)

(52) U.S. Cl. ..... 375/260; 375/267; 375/347; 342/124; 342/412; 342/434

(58) Field of Classification Search ..... 375/260, 375/267, 139; 342/417, 432, 440, 378, 124, 342/412, 434; 455/73
See application file for complete search history.

(56) References Cited

U.S. PATENT DOCUMENTS

| | | | | |
|---|---|---|---|---|
| 6,239,746 | B1 * | 5/2001 | Pipon et al. | 342/440 |
| 7,068,221 | B2 * | 6/2006 | Xin | 342/432 |
| 7,224,758 | B1 * | 5/2007 | Banister | 375/358 |
| 2003/0020650 | A1 * | 1/2003 | Chevalier et al. | 342/378 |
| 2003/0043929 | A1 * | 3/2003 | Sampath | 375/267 |
| 2004/0189523 | A1 * | 9/2004 | Kishigami et al. | 342/417 |
| 2005/0285788 | A1 * | 12/2005 | Xin | 342/432 |
| 2006/0194548 | A1 * | 8/2006 | Nagaraj | 455/73 |
| 2008/0001821 | A1 * | 1/2008 | Tanaka | 342/417 |

OTHER PUBLICATIONS

A. Cantoni, "Application of Orthoganal Perturbational Sequences to Adaptive Beamforming", *IEEE Transactions on Antennas and Propagation*, vol. AP-28, No. 2, Mar. 1980, pp. 191-202.
R. O. Schmidt, "Multiple Emitter Location and Signal Parameter Estimation", *IEEE Transactions on Antennas and Propagation*, vol. AP-34, No. 3, Mar. 1986, pp. 276-280.
R. O. Schmidt, "Multiple Source DF Signal Processing: An Experimental System", *IEEE Transactions on Antennas and Propagation* , vol. AP-34, No. 3, Mar. 1986, pp. 281-190.

* cited by examiner

*Primary Examiner*—Sudhanshu C Pathak
(74) *Attorney, Agent, or Firm*—Kenneth P. Robinson

(57) ABSTRACT

Prior adaptive antenna systems can reduce effects of a jamming or interfering signal by reducing antenna gain in the direction of such signal. However, direction finding capability to enable location of the source of such signal in order to permit corrective or other action has not been available on an economical, low computational basis. Described systems and methods provide correlation matrix estimation to enable direction finding. In an embodiment, a beamformer unit derives an adaptive output signal with use of odd symmetry sequence perturbation signals and weighting signals developed with use of odd symmetry sequence perturbation signals. An extractor unit utilizes even symmetry sequence perturbation signals to process a form of the adaptive output signal, in derivation of output signals representative of a correlation matrix usable for direction finding. The even symmetry sequence signals are thus used to process an adaptive output signal which includes even symmetry sequence values as a result of derivation of the adaptive output signal with interaction between components of odd symmetry sequence perturbation signals.

15 Claims, 7 Drawing Sheets

CORRELATION MATRIX ELEMENT ESTIMATES

| | | THEORETICAL | | INPUT DATA | | PERTURBATIONAL | |
|---|---|---|---|---|---|---|---|
| 1 | 1 | 2.00002 | 0.00000 | 1.99952 | 0.00000 | 2.00693 | 0.00000 |
| 1 | 2 | 0.93358 | -1.35837 | 0.93296 | -1.35840 | 0.94199 | -1.36306 |
| 1 | 3 | -0.25686 | -0.66913 | -0.25765 | -0.66880 | -0.26695 | -0.66790 |
| 2 | 1 | 0.93358 | 1.35837 | 0.93296 | 1.35840 | 0.94199 | 1.36306 |
| 2 | 2 | 2.00002 | 0.00000 | 1.99814 | 0.00000 | 2.00693 | 0.00000 |
| 2 | 3 | 0.93358 | -1.35837 | 0.93152 | -1.35633 | 0.92132 | -1.37014 |
| 3 | 1 | -0.25686 | 0.66913 | -0.25765 | 0.66880 | -0.26695 | 0.66790 |
| 3 | 2 | 0.93358 | 1.35837 | 0.93152 | 1.35633 | 0.92132 | 1.37014 |
| 3 | 3 | 2.00002 | 0.00000 | 1.99535 | 0.00000 | 2.00693 | 0.00000 |

CORRELATION MATRIX ESTIMATION VIA ADAPTIVE ARRAY PERTURBATIONAL PROCESSING TO ENABLE JAMMER LOCATION

RELATED APPLICATIONS (Not Applicable)

FEDERALLY SPONSORED RESEARCH (Not Applicable)

BACKGROUND OF THE INVENTION

The invention relates to array antenna systems and, more particularly, to such systems employing adaptive signal processing or beamforming to address aspects of jamming or interference.

Various forms and implementations of adaptive processing of signals received by array antennas have been suggested in order to provide antenna gain reduction in the direction from which a jamming signal emanates. Thus, if a pattern null or reduced gain characteristic can automatically or adaptively be provided at the appropriate azimuth, system sensitivity to jamming signals arriving at that azimuth will be reduced.

Application of perturbation sequences to adaptive beamforming has been described. Such techniques may be appropriate to enable adaptive processing in applications in which an antenna output representing a summation of signals received is available, but it is not possible or convenient to make available each signal received via individual elements of an array antenna. See for example, the article, "Application of Orthogonal Perturbation Sequences to Adaptive Beamforming" (*IEEE Transactions on Antennas and Propagation*, Vol. AP-28, No. 2, March 1980, pp. 191-202).

In addition to reduction of the effects of jamming or interference signals, it may be desirable to determine the actual direction from which such signals emanate. Thus, if available, information as to the direction of a jamming or interference signal might be used as the basis for action suitable to accomplish a cessation or reduction of such signal. However, known types of adaptive processing systems have not provided a direction finding capability.

Various forms and implementations of signal processing for the purpose of location or direction finding relative to the source or emitter of what may be a jamming or interference signal have been described. Prior known approaches have been based on the availability and processing of individual signals as received by each of a plurality of antenna elements in order to construct and analyze a matrix of cross correlations between the signals received by the individual elements. As a result, for an array antenna including a significant number of receiving elements, parallel processing of each received component signal and matrix analysis for this purpose can require provision of fairly extensive signal processing hardware and computational capacity. See for example the articles, "Multiple Emitter Location and Signal Parameter Estimation" and "Multiple Source DF Signal Processing: An Experimental System" (*IEEE Transactions on Antennas and Propagation*, Vol. AP-34, No. 3, March 1986, pp. 276-280 and 281-290, respectively).

An example of an area of interest is provision of adaptive array anti-jam and direction finding capabilities for use with Global Positioning Satellite (GPS) system array apertures of reduced or compact size. While small array configurations may be provided for adaptive processing usage, there are constraints on size, weight, cost and thus computational capacity in missile guidance and other applications.

As background, in existing adaptive processing applications, the most commonly used analog adaptive weight control is based on using the Least Mean Square (LMS) algorithm. The performance metric is the minimization of the output power from an array, subject to a weight vector constraint to avoid system shut down. This constraint can be addressed by use of a fixed weight on a reference input mode whose spatial response is high over the entire region from which desired satellite signals may emanate. A typical configuration, as diagramed in FIGS. 1 and 2 is based on taking small steps in the opposite direction of the instantaneous gradient of the output power with respect to the weight vector components. The instantaneous estimate of the gradient vector components are formed by multiplying the current value of the array outputs by the conjugate of the current value of each input. Since a received GPS satellite signal level can be expected to be sufficiently below the level of the undesired background or jamming, the received signals will not impact the adaptation process.

Although generally considered lowest in cost, the LMS algorithm can suffer from sub-optimal convergence properties in some scenarios. In addition, since this approach directly estimates the gradient, it does not provide a viable method for estimating the correlation matrix of the interference background, which could be used for direction finding. Without data providing an estimate of the correlation matrix, existing subspace direction finding algorithms, such as the MUSIC algorithm described in articles identified above, can not be applied for source location purposes.

For many applications, military or other, some or all of space, size, cost, power and data transmission constraints, as well as co-location and cabling constraints, may foreclose or make impractical the use of known signal source location or direction finding techniques, such as those referred to above. As a result, even though there may be provided an array antenna system including adaptive processing for reduction of jamming or interference effects, there may be no applicable location or direction finding arrangements capable of being implemented on a cost-effective and size and form basis which meets the applicable constraints.

Objects of the present invention are, therefore, to provide new and improved systems and methods applicable to enabling signal source location and which may overcome one or more of cost, size and other constraints applicable to implementation of previously available arrangements.

SUMMARY OF THE INVENTION

In accordance with one embodiment of the invention, a correlation matrix estimation system, usable with an array of radiating elements arranged to provide a set of received signals, may include the following. A signal unit is arranged to provide sequences of perturbation signals, including odd symmetry sequences and even symmetry sequences. A beamformer unit, coupled to the array and to the signal unit, is arranged to modify representations of received signals to provide an adaptive output signal. Such modification is implemented in response to control signals based on values of at least one odd symmetry sequence of perturbation signals and a plurality of weighting signals. A weighting signal unit, coupled to the beamformer and signal units, is responsive to a representation of the adaptive output signal and at least one odd symmetry sequence of perturbation signals and is arranged to provide the plurality of weighting signals for use by the beamformer unit. A matrix extractor unit, coupled to beamformer and signal units, is arranged to process a representation of the adaptive output signal, with use of at least one even symmetry sequence of perturbation signals, to provide signals representative of a correlation matrix usable for direction finding purposes.

In some applications, the correlation matrix estimation system may also include a direction finding processor arranged to utilize the signals representative of a correlation matrix to estimate the direction of a signal source relative to the array of radiating elements.

Also in accordance with the invention, a correlation matrix estimation method, usable with an array of radiating elements arranged to provide a set of received signals, may include some or all of the following steps:

(a) providing sequences of perturbation signals;

(b) modifying a representation of the set of received signals, in response to control signals based on interaction between at least one sequence of perturbation signals and a plurality of weighting signals, to provide an adaptive output signal;

(c) providing, for use in step (b), a plurality of weighting signals based on interaction between a representation of the adaptive output signal and at least one sequence of perturbation signals; and (d) processing a representation of the adaptive output signal, with use of at least one sequence of perturbation signals, to provide signal outputs representative of a correlation matrix estimation usable for direction finding purposes.

In some applications, step (a) above may include providing sequences of perturbation signals including odd symmetry sequences and even symmetry sequences and coupling:

at least one odd symmetry sequence of perturbation signals for use as stated in step (b);

at least one odd symmetry sequence of perturbation signals for use as stated in step (c); and at least one even symmetry sequence of perturbation signals for use as stated in step (d).

Also, in some applications, a correlation matrix estimation method may additionally include the step of:

(e) using said signal outputs for direction finding purposes.

For a better understanding of the invention, together with other and further objects, reference is made to the accompanying drawings and the scope of the invention will be pointed out in the accompanying claims.

DESCRIPTION OF THE INVENTION

Figure 3:
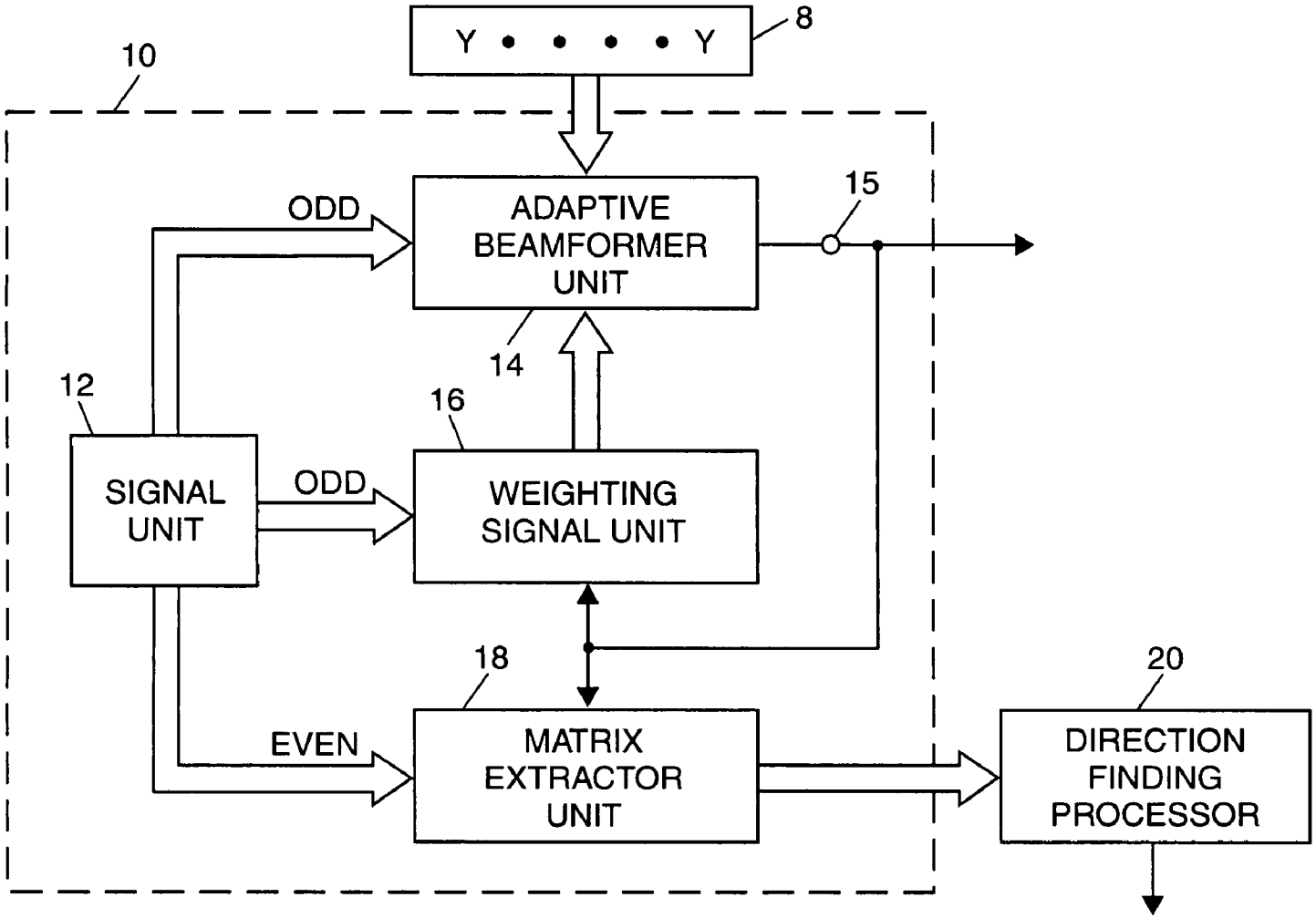
FIG. 3 shows an embodiment of a correlation matrix estimation system using sequences of perturbation signals.

Referring to FIG. 3, there is illustrated one embodiment of a correlation matrix estimation system 10 pursuant to the invention. As shown, system 10 is usable with an array 8 of radiating elements arranged to provide a set of received signals (e.g., one received signal for each element).

System 10 includes a signal unit 12 arranged to provide sequences of perturbation signals, including odd symmetry sequences and even symmetry sequences. As will be described further, such sequences of signals are applied for purposes of perturbing weighting signals employed in adaptive beamformer unit 14, providing perturbation in the development of weighting signals in weighting signal unit 16, and providing perturbation in operation of matrix extraction unit 18. In an example to be described, selected odd symmetry perturbation sequence signals may be supplied to units 14 and 16 and selected even symmetry perturbation sequence signals may be supplied to unit 18, as represented in FIG. 3. Each sequence of perturbation signals may be in the form of a known type of Walsh sequence or other suitable format.

Beamformer unit 14 is coupled to the radiating elements of array 8 and to signal unit 12 and arranged to provide an adaptive output signal at output port 15 (e.g., a composite signal $Z_{OUT}$ which is representative of signals received by the individual radiating elements of array 8 after being processed and combined pursuant to perturbational adaptive processing). To provide such an output signal, beamformer unit 14 is arranged to modify representations of the received signals in response to control signals based on values of at least one odd symmetry sequence of perturbation signals from signal source 12 and a plurality of weighting signals from weighting signal unit 16, as will be further described. While, for purposes of illustration various signals are shown as being directly coupled between units, in particular implementations additional processing, amplification, cable routing, etc., may be included in the form of intermediate units or otherwise, as determined by skilled persons to be appropriate.

Figure 1:
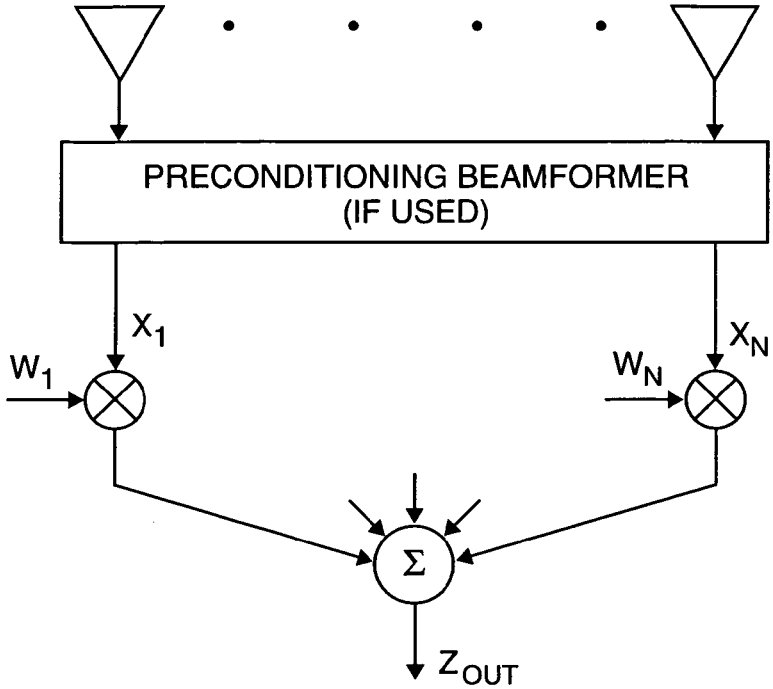
FIG. 1 PRIOR ART
FIG. 1 provides a representation of prior art adaptive processing of array signals by use of least mean square (LMS) weighting signals.
Figure 2:
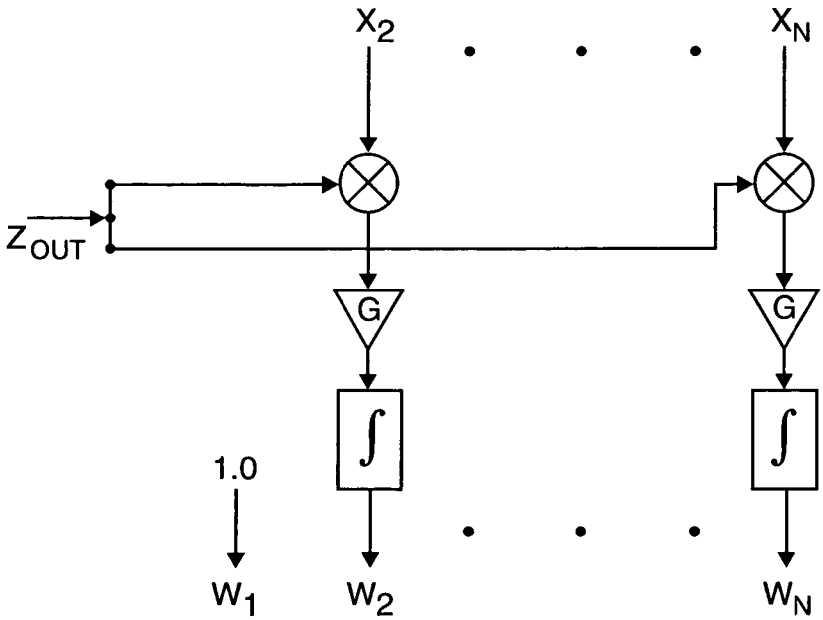
FIG. 2 PRIOR ART
FIG. 2 shows a form of prior art controller arranged to derive LMS weighting signals for adaptive processing.

Weighting signal unit 16 is responsive to the adaptive output signal from port 15, or a suitable derivative or processed form thereof, and to at least one odd symmetry sequence of perturbation signals from signal unit 12 and is arranged to provide the plurality of weighting signals referred to above as being provided to the beamformer unit 14, as illustrated. Thus, while weighting signals are commonly employed in LMS or other adaptive antenna arrangements, in the FIG. 1 system weighting signals are provided with use of perturbation signals and, in this configuration, more particularly by use of selected odd symmetry perturbation sequence signals provided to unit 16.

Matrix extractor unit 18 is shown coupled to the beamformer unit 14 (i.e., output port 15 thereof) and to the signal unit 12, and is arranged to provide signals representative of a correlation matrix usable for purposes of estimating the direction of a signal source relative to the array of radiating elements. To do this, unit 18 is arranged to process a representation of the adaptive signal output (e.g., from port 15) with such processing implemented in this example with use of at least one even symmetry sequence of perturbation signals from signal unit 12. As will be described further, pursuant to the invention, although unit 18 receives the adaptive output signal without access to the individual signals as received by individual radiating elements of the array 8, by use of selected even symmetry perturbation sequence signals unit 18 is enabled to provide signals representative of the correlation matrix. More particularly, such signals can be provided in a form processable by known techniques of correlation matrix processing for direction finding, to enable estimation of the direction of a signal source (e.g., a source of jamming or interference).

As shown in FIG. 3, the correlation matrix estimation system as described may additionally include a direction finding processor 20. With the availability of signals representative of a correlation matrix as provided by matrix extractor unit 18, such signals may be processed using known techniques for direction finding purposes. Thus, skilled persons will be capable of implementing suitable direction finding processing employing known techniques and arrangements in configurations suitable for particular applications.

Figure 4:
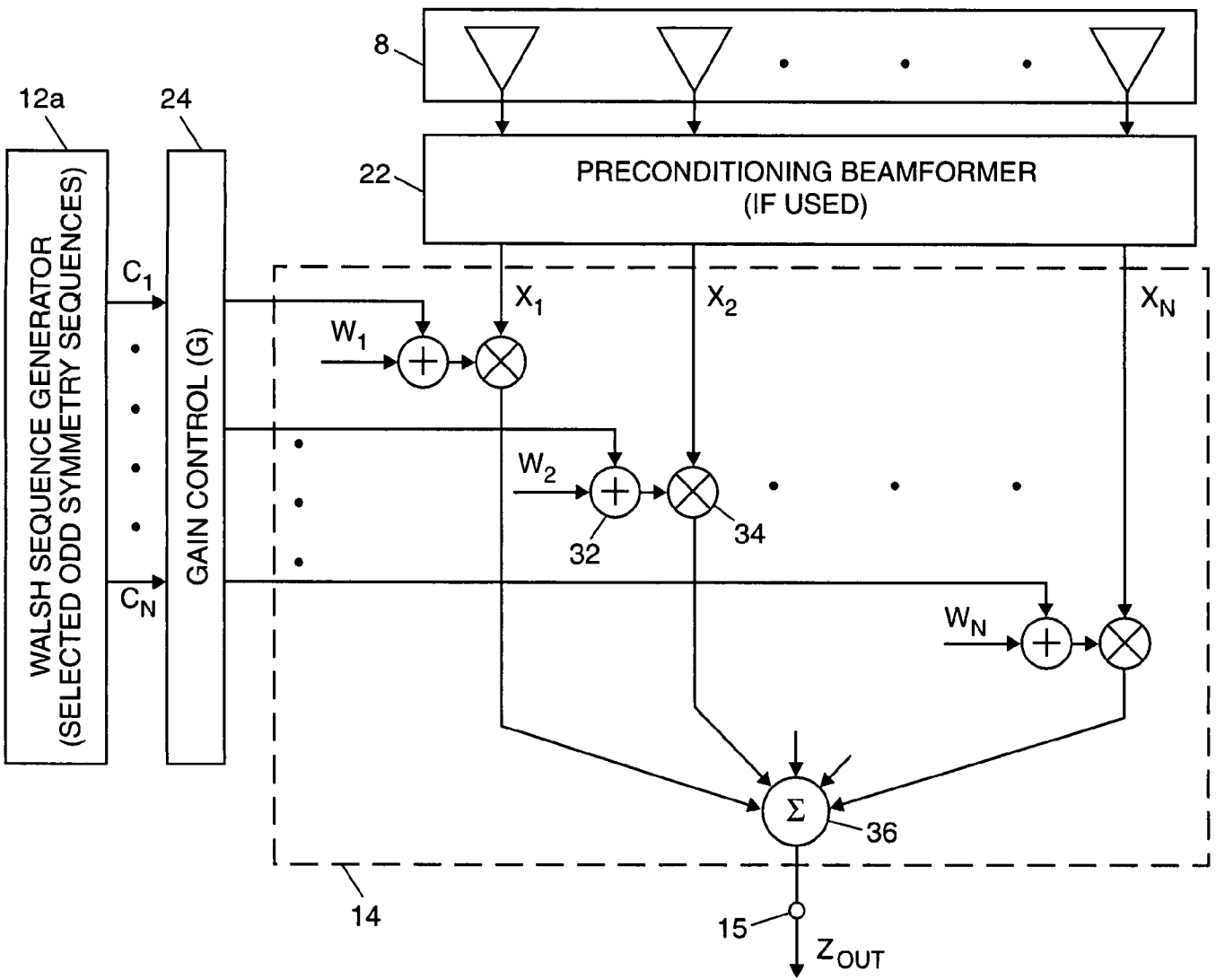
FIG. 4 shows a form of adaptive beamformer unit usable in the FIG. 3 system.

FIG. 4 shows a configuration of beamformer unit 14 in additional detail. In FIG. 4, the radiating elements of array 8 are coupled to beamformer unit 14 via a preconditioning beamformer unit 22 which may be employed for purposes of initial processing of received signals to provide desired phase, gain or other adjustments or relationships between or among the set of received signals using known techniques as appropriate in particular implementations. Also in FIG. 4, the function of signal unit 12 is provided by Walsh sequence generator 12*a* arranged to provide known types of selected Walsh sequences of odd symmetry and followed by a gain control unit 24 arranged to provide predetermined gain relationships to the sequence signals from generator 12*a*.

In the beamformer unit 14 of FIG. 4, weighting signals $W_2$ through $W_N$ (provided by weighting unit 16 as will be described, with $W_1$ set at unity) are combined with low-level perturbation sequence signals $C_1$-$C_N$ supplied by Walsh sequence generator 12*a* via gain control unit 24. Thus, signal $C_1$ may be added to weighting signal $W_1$, etc., in a plurality (e.g., N) of adder devices, a typical one of which is represented by adder device 32 in FIG. 4. The sequence values as added to each weighting component are orthogonal so as to allow unique evaluation of each weight vector component. The number of unique sequences employed must be at least twice the number of the radiating elements in the array to accommodate both the real and the imaginary components of each weight vector. The weighting components, as modified by addition of the sequence values, in conjunction with $Z_{OUT}$, allow a representation of a current estimate of the gradient vector. These modified weighting components as provided at the outputs of the adder devices (e.g., adder device 32) are applied to a plurality (e.g., N) multiplier devices, a typical one of which is represented by multiplier device 34 in FIG. 4. This may be implemented in a manner similar to the application of weighting signals to signals from individual radiating elements in known forms of least mean square (LMS) processing in prior adaptive antenna systems. This processing is effective, after summing of the weight adjusted individual signals in summing device 36, to provide an adaptive output signal $Z_{OUT}$ at output port 37. This signal can be used in known fashion for further processing of information made available by signal reception via the array 8.

It should be noted that the labeled variables included in FIG. 4 are complex quantities having real and imaginary parts. Consistent with that, the Walsh codes labeled $C_1$, etc., also have the form of complex quantities, each consisting of real and imaginary parts that are different odd symmetry Walsh sequences. In this configuration, $X_1$ may be considered as the signal representing the signal received by a reference radiating element of the array 8, with the weighting signal $W_1$ as applied to signal $X_1$ set at a reference level (e.g., a value of 1). As shown, a complex Walsh sequence $C_1$ is added with respect to the reference element, as well as to signals provided for each of the other radiating elements of array 8. The reference element Walsh code would not typically be utilized in the adaptive nulling process but is needed for use in the correlation matrix extraction processing associated with matrix extractor unit 18.

The adaptive output signal as made available at output port 15 will include residual low-level sequence components which can be reduced or eliminated, if necessary in the particular application. This can be accomplished by use of a two receiver balanced configuration (as compared to the simpler single receiver arrangement which has been shown and described) and, in addition, by placing additional constraints on the sequences employed. As for most adaptive processing implementations, consideration can be given to providing operational balance between system stability, convergence speed and mis-adjustment noise and those factors can be addressed by skilled persons with application of known techniques. In particular, in the illustrated embodiment, control of gain applicable to the sequences employed (e.g., via gain control unit 24) can be used to provide control or adjustment of trade-offs between some or all of the factors referred to.

Figure 5:
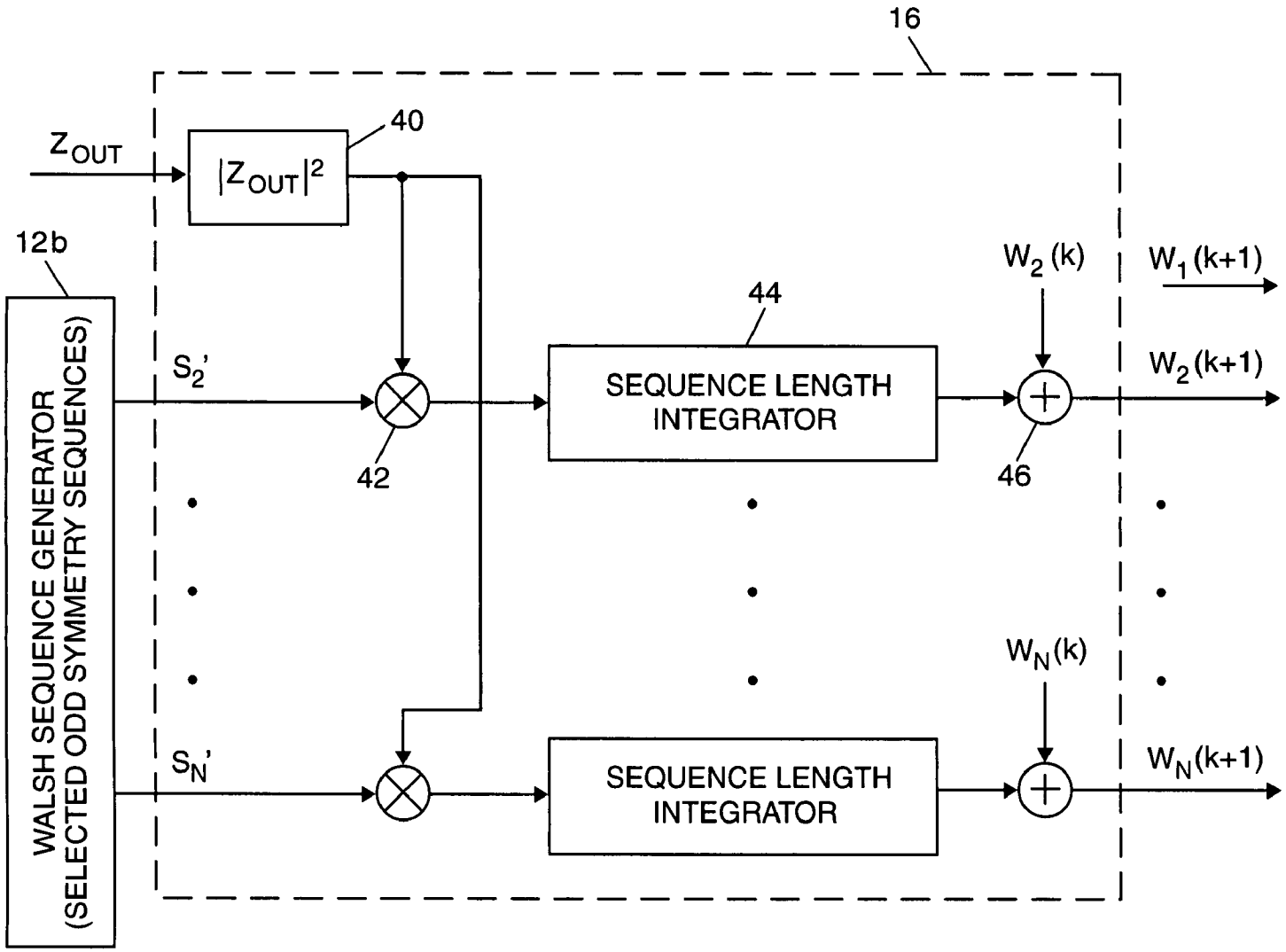
FIG. 5 shows a form of weighting signal unit usable in the FIG. 3 system.

FIG. 5 shows a configuration of weighting signal unit 16 in additional detail. In FIG. 5, a representation of the adaptive output signal $Z_{OUT}$ from beamformer unit 14 is provided in the form of $|Z_{OUT}|^2$ at element 40. Portions thereof are combined via a plurality of multiplier devices, a typical one of which is represented by multiplier device 42 in FIG. 5, with sequence signals $S_2$,-$S_N$, supplied by Walsh sequence generator 12*b*. The selected Walsh sequences provided by generator 12*b* may typically be the same odd symmetry sequences as provided by generator 12*a* and, where appropriate, may be provided by generator 12*a*, with generator 12*b* omitted. Outputs of the multiplier devices (e.g., device 42) are processed via a plurality of sequence length integrator units, a typical one of which is represented by unit 44 in FIG. 5, to estimate components of the gradient vector by cross-correlating the sequence values with the instantaneous adaptive output power signal, which was subjected to perturbational processing by use of corresponding sequence values as discussed above. Outputs from the integrator units (e.g., unit 44) are then combined with weighting values $W_2(k)$-$W_N(k)$ (e.g., similar to those provided as in known forms of LMS adaptive processing) via a plurality of adder devices, a typical one of which is represented by adder device 46 in FIG. 5. The resulting weighting signal outputs $W_2(k+1)$-$W_N(k+1)$ and reference value $W_1(k+1)$ as provided by weighting signal unit 16 are coupled back for use in adaptive beamformer unit 14, as represented in FIG. 3.

The foregoing discussion of FIGS. 4 and 5 addresses application of aspects of known techniques of perturbational processing as implemented in the context of the invention. The basic result is to provide as adaptive output signal which has been derived with the benefits of perturbational processing, so as to represent the usual extent of such processing in the context of application to an adaptive antenna system. Pursuant to the invention, however, such processing has been implemented in the context of and for the purpose of enabling derivation of a form of adaptive output signal which is capable of being processed so as to provide signals representative of the background correlation matrix consistent with the received signals and usable for purposes of estimating signal source directivity. It should be noted that when perturbational processing is used only for array adaptive nulling any set of odd symmetry Walsh functions can be utilized. Further, no odd symmetry Walsh function need be associated with the reference input mode. However, in the context of the present systems certain constraints must be applied in selecting a suitable subset of odd symmetry Walsh functions. These constraints are discussed below. In addition, a suitable odd symmetry Walsh function must be associated with the reference input mode.

Figure 6:
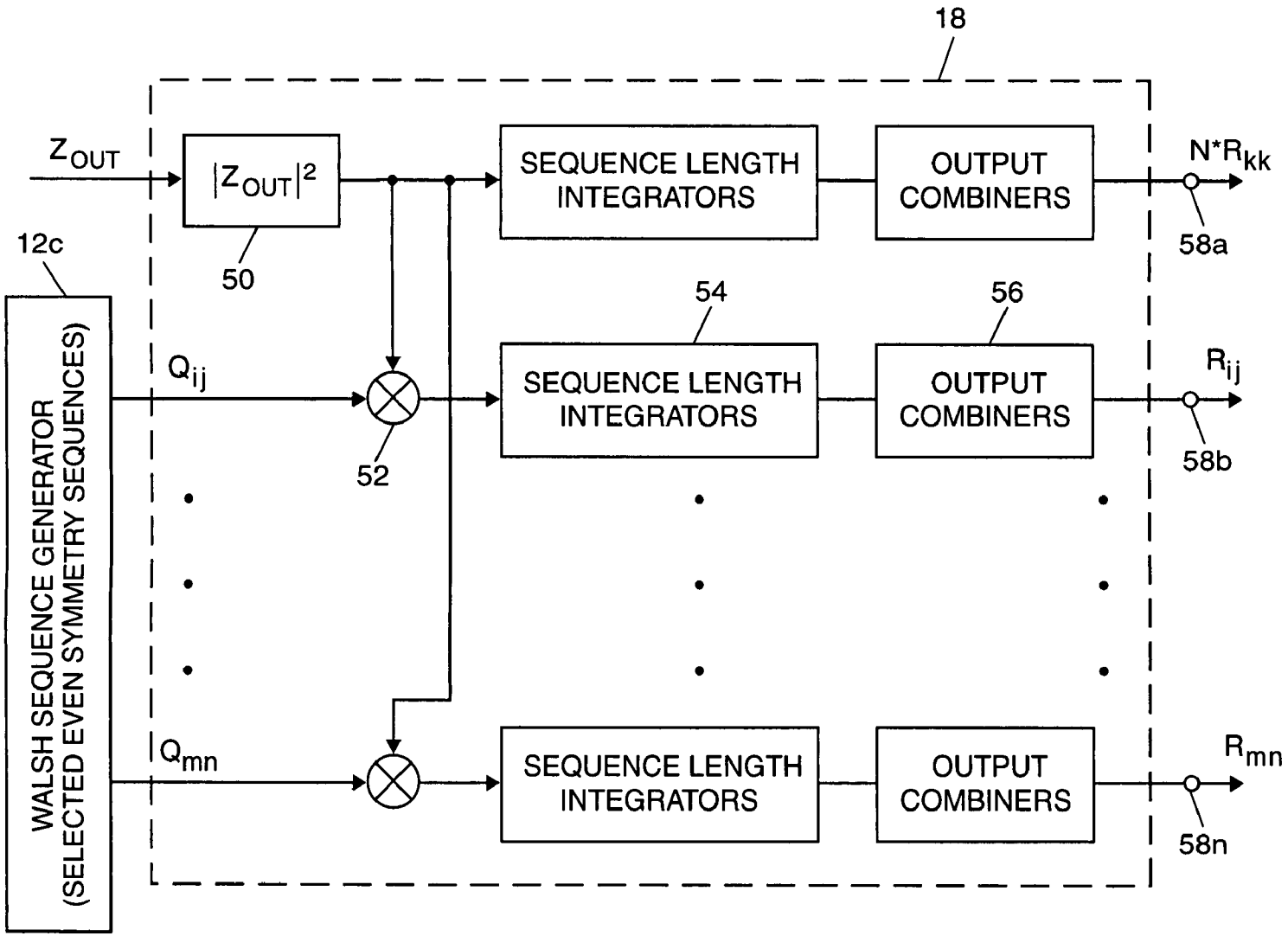
FIG. 6 shows a form of matrix extractor unit usable in the FIG. 3 system.

FIG. 6 shows a configuration of matrix extractor unit 18 in additional detail. In FIG. 6, a representation of the adaptive output signal $Z_{OUT}$ from beamformer unit 14 is provided in the form of $|Z|^2$ at element 50. Portions thereof are combined via a plurality of multiplier devices, a typical one of which is represented by multiplier device 52 in FIG. 6, with perturbation sequence signals $Q_{ij}$ through $Q_{mn}$ supplied by Walsh sequence generator 12*c*. In this embodiment, selected Walsh sequences from generator 12*c* are provided as even symmetry sequences as will be further described. For example, $Q_{ij}$ is the even symmetry Walsh function equal to the product of the $i^{th}$ and $j^{th}$ odd symmetry Walsh functions which are supplied to the units 14 and 16 in FIGS. 4 and 5. Outputs of the multiplier devices (e.g., device 52) are processed via a plurality of series combinations of sequence length integrator units and output combiners, typical ones of which are represented by respective units 54 and 56 of FIG. 6, to provide signal outputs at output ports 58*b*-58*n* representative of a correlation matrix usable for direction finding purposes as discussed. At output port 58*a* there is provided in parallel a signal output representing a reference level matrix component usable with the other signal outputs. Used in combination, these signal outputs represent the correlation matrix estimate values appropriate for use in direction finding, as well as other possible forms of non-linearly weight constrained adaptations which may be appropriate.

The current approach to providing information adequate to the determination of the correlation matrix components is based on a determination that the product of two Walsh functions with odd symmetry is a Walsh function with even symmetry. Further, that the expansion of $|Z_{OUT}|^2$ contains a double summation of three types of terms: 1) Terms that are products of the current weight values, 2) Terms that contain products of a weight and a code, and 3) Terms that contain products of two code sequences. When time averaged over a code length the products of an even symmetry Walsh function, (except for the code of all 1's), with any of the terms of types 1 and 2 are all zero. However, the average of the product with terms of type 3) corresponds to the $ij^{th}$ term of the auto correlation matrix when the even symmetry Walsh sequence corresponds to the product of the $i^{th}$ and $j^{th}$ odd symmetry Walsh sequences. A complication can arise because the products of pairwise odd sequences are not all unique even sequences. However, it has been established that for $i \neq j$ a subset of odd sequences can be selected that provide unique even sequence products. An effect of this limitation is that longer Walsh sequences are required if the autocorrelation matrix terms are to be retrieved. In addition, the sequence product for all terms where $i=j$ is the sequence of all 1's. Therefore, a basic direct output in the present context would yield the sum of all of the $ii^{th}$ terms without a method for decomposing the sum. However, if the array is fed with element port inputs from identical elements, or with equal output powers through use of automatic gain control, then the correlation value of each element is 1.0/N times the total output, enabling processing for the diagonal cross-correlation matrix terms.

Based on the foregoing, skilled persons using adaptive, perturbational and other techniques will be enabled to provide implementations consistent with the systems and methods described, as appropriate for particular applications as well as other and further variations and arrangements employing the invention. For example, it is noted that attained reduction of undesired background (e.g., interfering signals) includes both desired effects of reduction of input interference and noise, as well as relatively low level undesired effects of the instantaneous misadjustment of the adaptive weights caused by the "dithering" effects of the perturbational sequence signals. Without such dithering deeper adaptive nulling can be provided. There are a number of known techniques which can be employed to reduce or eliminate effects of the dithering, but which somewhat increase hardware complexity and cost. One technique is to use a parallel set of undithered "freeze" weights in the actual signal path. Such techniques can be evaluated by skilled persons for use in view of cost, complexity and other constraints pertinent in particular applications.

Figure 7:
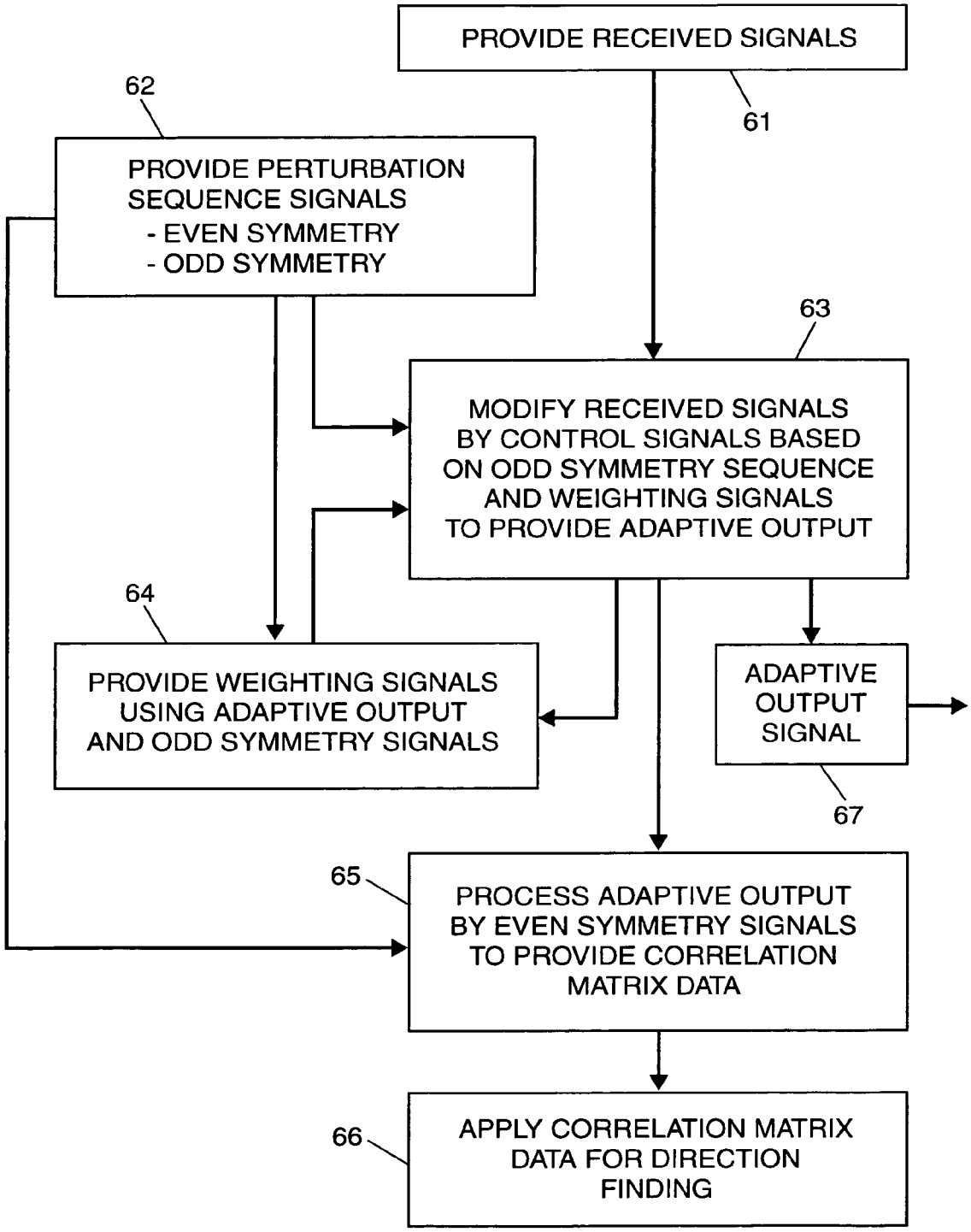
FIG. 7 is a form of flow chart useful in describing a correlation estimation method.

FIG. 7 is a form of flow chart useful in describing the steps of an exemplary method employing the invention in the context of correlation matrix estimation system 10 of FIG. 3.

At step 61, there is provided a set of signals as received by an array of radiating elements such as array 8 of FIG. 3. Such signals may be initially processed by a preconditioning beamformer such as unit 22 of FIG. 4.

At step 62, there are provided sequences of perturbation signals, including selected odd symmetry and selected even symmetry sequences of signals, as supplied by signal unit 12 of FIG. 3 and Walsh sequence generators 12*a*, 12*b* and 12*c* as represented in FIGS. 4, 5, and 6, respectively.

At step 63, the set of received signals is modified (e.g., in unit 14) by use of control signals based on interaction between at least one odd symmetry sequence of perturbation signals from unit 12 (e.g., unit 12*a* of FIG. 4) and weighting signals from weighting signal unit 16, to provide an adaptive output signal identified as $Z_{OUT}$ at output port 15 in FIG. 4. This adaptive output signal can be used as the output signal for normal signal reception purposes and is also used for processing purposes within system 10.

At step 64, there is provided the plurality of weighting signals used as described in step 63. The weighting signals, as developed in unit 16, are based on interaction between a form of the adaptive output signal from unit 14 and at least one odd symmetry sequence of perturbation signals from unit 12 (e.g., unit 12*b* of FIG. 5) with the resultants combined with weighting values to provide the weighting signals for step 63.

At step 65, there are provided signals representative of a correlation matrix estimation usable for the purpose of estimating the direction of a signal source (e.g., a source of jamming or interference signals) relative to the array of radiating elements. Thus, there is processed (e.g., in unit 18) a representation of the adaptive output signal, with use of at least one even symmetry sequence of perturbation signals from unit 12 (e.g., unit 12*c* of FIG. 6), to provide such correlation matrix estimation signals. As discussed above, products of selected odd symmetry perturbational sequences provide unique even sequence values contained in the adaptive output signal, which thus enable processing in unit 16 by use of selected even symmetry sequences for purposes of the invention.

At step 66, direction finding processing may be implemented (e.g., in unit 20) on the basis of the correlation matrix estimation signals as developed in unit 18.

Thus, it will be seen that in the method as described, the sequences of perturbation signals provided in step 62 are coupled as follows:

at least one odd symmetry sequence of such signals is coupled for use in step 63;

at least one odd symmetry sequence of such signals is coupled for use in step 64;

at least one even symmetry sequence of such signals is coupled for use in step 65.

The method as described thus makes advantageous use of the resultant of development of an adaptive output signal which includes low level even symmetry sequence value signals (resulting from use of odd symmetry sequence signals in steps 63 and 64) to implement in step 65 processing of that adaptive output signal by use of even symmetry sequences in order to provide the signals representative of the correlation matrix.

Figures 8, 9:
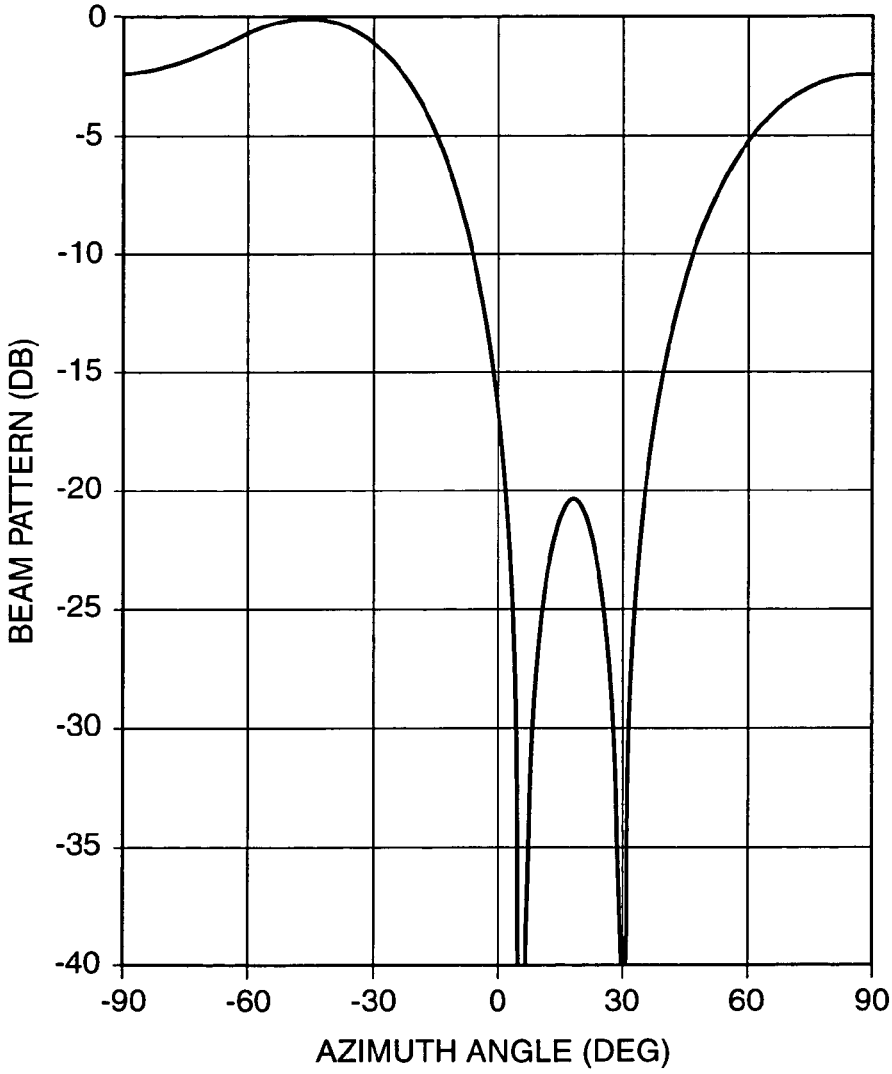
FIG. 8 provides comparison data for perturbational derivation of correlation matrix value estimation.
FIG. 9 shows an array antenna pattern corresponding to perturbational adaptive processing based on weighting values provided in FIG. 8.

FIG. 8 provides tabular data for perturbational derivation of estimations of correlation matrix values by operation of the systems and methods described, in comparison to correlation matrix values determined based upon relatively extensive processing employing all of the individual parallel signals as received by an array of radiating elements. More particularly, the data relates to an example of a three element line array of omnidirectional radiating elements. Two interfering sources (e.g., jammer or interference) were assumed to provide signals of equal strength, one located at a direction of 30 degrees and the other at a direction of 6.7 degrees relative to the array (i.e., relative to array broadside). The independent noise at each element was 47 dB below that of a single interferer source. As a result of the asymmetry of the interferer locations, the correlation matrix has a complex Hermitian, rather than a real, structure.

In the table, the first two columns provide the matrix element row and column indices. The next two columns, headed "Theoretical", list the real and imaginary parts of the element cross-correlations as derived by a closed form analysis of the input scenario. The next two columns, headed "Input Data", represent estimates of the complex correlation coefficients as derived by cross multiplying simulation input data samples at different array elements and time averaging the products. The last two columns, headed "Perturbational", represent the estimation of the complex correlation coefficients of the correlation matrix as derived by using the perturbational approach pursuant to the systems and methods as described above.

As established by the data, there was good agreement between the perturbational approach and the other direct or more computationally complex methods of determination. These results thus are effective to support the efficacy of the perturbational approach and potential for realizing the benefits of reduced cost, size and complexity and other aspects attributable to implementation of the perturbational systems and methods as described.

As to the associated adaptive processing results attained as determined by computer analysis for this scenario, FIG. 9 shows the computed antenna pattern for the array. The pattern has deep nulls in the directions (i.e., 30 and 6.7 degrees) of the interfering signal sources. The array output background power, about −23.0 dB, is about 26 dB below that of the total input interference level. Although FIG. 8 indicates nulls that extend deeper than −40 dB, in this implementation the output background power level was bounded by the additive weight perturbation components. This does not affect the showing of operative effectiveness of the perturbational approach.

While there have been described the currently preferred embodiments of the invention, those skilled in the art will recognize that other and further modifications may be made without departing from the invention and it is intended to claim all modifications and variations as fall within the scope of the invention.

What is claimed is:

1. A correlation matrix estimation system, usable with an array of radiating elements arranged to provide a set of received signals, comprising:

a signal unit arranged to provide sequences of perturbation signals, including odd symmetry sequences and even symmetry sequences;

a beamformer unit coupled to said array and to said signal unit and arranged to modify representations of said received signals, in response to control signals based on values of at least one odd symmetry sequence of said perturbation signals and a plurality of weighting signals, to provide an adaptive output signal;

a weighting signal unit coupled to said beamformer and signal units, responsive to a representation of said adaptive output signal and at least one odd symmetry sequence of said perturbation signals, and arranged to provide said plurality of weighting signals for use by said beamformer unit; and a matrix extractor unit coupled to said beamformer and signal units and arranged to process a representation of said adaptive output signal, with use of at least one even symmetry sequence of said perturbation signals, to provide signals representative of a correlation matrix usable for direction finding purposes.

2. A correlation matrix estimation system as in claim 1, additionally comprising:

a direction finding processor arranged to utilize said signals representative of a correlation matrix to estimate the direction of a signal source relative to said array of radiating elements.

3. A correlation matrix estimation system as in claim 1, wherein the signal unit is arranged to provide sequences of perturbation signals comprising sequences of Walsh functions.

4. A correlation matrix estimation system as in claim 1, wherein the beamformer unit comprises multiplier devices responsive to said control signals and adder devices arranged to combine values of said at least one odd symmetry sequence and said weighting signals.

5. A correlation matrix estimation system as in claim 1, wherein the weighting signal unit comprises multiplier devices arranged for operation to combine values of said at least one odd symmetry sequence and signal portions representative of said adaptive output signal, integrator units to provide integration processing of resultants of said operation and adder devices to combine signals from the integrator units with weighting values to provide said weighting signals.

6. A correlation matrix estimation system as in claim 1, wherein the matrix extractor unit comprises multiplier devices arranged for operation to combine values of said at least one even symmetry sequence and signal portions representative of said adaptive output signal.

7. A correlation matrix estimation system as in claim 6, wherein the matrix extractor unit further comprises sequence length integrator devices arranged to process resultants of said operation to combine.

8. A correlation matrix estimation system as in claim 1, wherein said beamformer unit is arranged to provide an adaptive output signal incorporating even symmetry sequence values, as a result of interaction between said odd symmetry sequence signals utilized by said beamformer and weighting signal units; and said matrix extractor unit is arranged to provide said signals representative of a correlation matrix, based on interaction between said odd symmetry sequence values incorporated in the adaptive output signal and said at least one even symmetry sequence of perturbation signals used by the matrix extractor unit.

9. A correlation matrix estimation method, usable with an array of radiating elements arranged to provide a set of received signals, comprising the steps of:

(a) providing sequences of perturbation signals, including odd symmetry sequences and even symmetry sequences;

(b) modifying, via a beamformer unit, a representation of said set of received signals, in response to control signals based on interaction between at least one sequence of said perturbation signals and a plurality of weighting signals, to provide an adaptive output signal;

(c) providing, for use in step (b), a plurality of weighting signals based on interaction between a representation of said adaptive output signal and at least one sequence of said perturbation signals; and (d) processing a representation of said adaptive output signal, with use of at least one sequence of said perturbation signals, to provide signal outputs representative of a correlation matrix estimation usable for direction finding purposes.

10. A correlation matrix estimation method as in claim 9, wherein step (a) comprises providing sequences of perturbation signals including odd symmetry sequences and even symmetry sequences and coupling:

at least one odd symmetry sequence of said perturbation signals for use as stated in step (b);

at least one odd symmetry sequence of said perturbation signals for use as stated in step (c); and at least one even symmetry sequence of said perturbation signals for use as stated in step (d).

11. A correlation matrix estimation method as in claim 9, wherein step (a) comprises providing odd symmetry Walsh sequences of perturbation signals and even symmetry Walsh sequences of perturbation signals.

12. A correlation matrix estimation method as in claim 9, additionally comprising the step of:

(c) using said signal outputs for direction finding purposes.

13. A correlation matrix estimation method as in claim 9, wherein step (b) comprises providing additive interaction between at least one odd symmetry sequence of said perturbation signals and said plurality of weighting signals to provide control signals and modifying a representation of said set of received signals with use of said control signals to provide an adaptive output signal.

14. A correlation matrix estimation method as in claim 9, wherein step (d) comprises processing a representation of said adaptive output signal by multiplicative interaction of portions thereof with signals of at least one sequence of said perturbation signals to provide component signals.

15. A correlation matrix estimation method as in claim 14, wherein step (d) further comprises subjecting said component signals to integrating action to provide signal outputs representative of a correlation matrix estimation usable for direction finding purposes.

* * * * *